US008179349B2

(12) United States Patent
Liao et al.

(10) Patent No.: US 8,179,349 B2
(45) Date of Patent: May 15, 2012

(54) PIXEL STRUCTURE AND DRIVING METHOD THEREOF

(75) Inventors: Tai Shun Liao, Douliu (TW); Po Sheng Shi, Hsinchu (TW); Chao Hui Wu, Taoyuan County (TW)

(73) Assignee: Hannstar Display Corp., Taipei (TW)

( * ) Notice: Subject to any disclaimer, the term of this patent is extended or adjusted under 35 U.S.C. 154(b) by 311 days.

(21) Appl. No.: 12/688,993

(22) Filed: Jan. 18, 2010

(65) Prior Publication Data

US 2010/0220116 A1 Sep. 2, 2010

(30) Foreign Application Priority Data

Feb. 27, 2009 (TW) ..... 98106293 A

(51) Int. Cl.
*G09G 3/36* (2006.01)

(52) U.S. Cl. ..... 345/89; 345/696

(58) Field of Classification Search ..... 345/89, 345/696, 204, 87, 90, 92
See application file for complete search history.

(56) References Cited

FOREIGN PATENT DOCUMENTS

CN 101625489 A 1/2010

OTHER PUBLICATIONS

Sang Soo Kim et al., "82" Ultra Definition LCD Using New Driving Scheme and Advanced Super PVA Technology, SID 08 DIGEST, pp. 196-199, ISSN/008-0966X/0803901-0196.

*Primary Examiner* — Ricardo L Osorio
(74) *Attorney, Agent, or Firm* — Lowe, Hauptman, Ham & Berner, LLP

(57) ABSTRACT

A pixel structure includes a first sub-pixel and a second sub-pixel. The first sub-pixel includes a first switching transistor and a first liquid crystal capacitor, wherein when the first switching transistor is turned on, the first liquid crystal capacitor is biased to a first gray level voltage. The second sub-pixel includes a second switching transistor, a second liquid crystal capacitor, a third switching transistor, a charge sharing capacitor and a fourth switching transistor, wherein when the second switching transistor is turned on, the second liquid crystal capacitor is biased to the first gray level voltage; when the fourth switching transistor is turned on, the charge sharing capacitor is reset to a predetermined voltage; and when the third switching transistor is turned on, the second liquid crystal capacitor and the charge sharing capacitor are charge-shared to a second gray level voltage through the third switching transistor.

20 Claims, 6 Drawing Sheets

PIXEL STRUCTURE AND DRIVING METHOD THEREOF

CROSS REFERENCE TO RELATED APPLICATION

This application claims the priority benefit of Taiwan Patent Application Serial Number 098106293, filed on Feb. 27, 2009, the full disclosure of which is incorporated herein by reference.

BACKGROUND

1. Field of the Invention

This invention generally relates to a liquid crystal display and, more particularly, to a pixel structure of a wide view angle liquid crystal display and to a driving method thereof.

2. Description of the Related Art

In large size liquid crystal display, as pixels are spread over a greater area, a user is impossible to look squarely at the image shown by each pixel on the display during watching. Therefore, brightness and contrast differences will be observed by the user while watching at different angles. In order to overcome this problem, wide view angle techniques have been proposed and a scheme named multi-domain vertical alignments (MVA) has been confirmed to be able to effectively improve the color washout. The capacitance coupling type (C.C. type) pixel structure is a sort of wide view angle technique. Although it is not necessary to change the driving method of a display when using this type of pixel structure, the image sticking is another issue to be considered during image display. Another wide view angle technique, named two transistors type (T.T. type) pixel structure, has solved the image sticking problem, but the number of gate lines or data lines used in this pixel structure has to be doubled such that the manufacturing cost will be increased.

To solve the problems existing in conventional pixel structures, Samsung Electronics proposed a charge-shared type pixel structure 9, including a sub-pixel 91 and a sub-pixel 92, at SID Symposium Digest 2008, as shown in FIG. 1. Through charge sharing between capacitors, the sub-pixel 92 and sub-pixel 91 of the pixel structure 9 may have different gray level voltages during operation. However, because the capacitor $C_S$ will keep at the voltage of previous frame before TFT3 is turned on, the sub-pixel 92 is difficult to accurately reach a desired voltage level through charge sharing when TFT3 is turned on. Accordingly, the gray level shown by the sub-pixel 92 for each frame will be influenced by previous frame and is different from actually desired gray level.

Please refer to FIGS. 1 and 2, FIG. 2 shows a voltage timing diagram of the capacitors in the two sub-pixels shown in FIG. 1 when the voltage of the pixel structure 9 switches from a high gray level to a middle gray level, wherein $t_1$ is a time period that the first gate line Gn turns on the pixel structure 9 and $t_2$ is a time period that the second gate line Gn+1 turns on a pixel structure, adjacent to the pixel structure 9, connected thereto. As shown in FIG. 2, within the time period $t_1$, the first gate line Gn simultaneously turns on the switching transistors TFT1 and TFT2 such that the voltage $V_{C1}$ of the liquid crystal capacitor $C_{LC1}$ of the sub-pixel 91 and the voltage $V_{C2}$ of the liquid crystal capacitor $C_{LC2}$ of the sub-pixel 92 decrease to a middle gray level voltage together according to the voltage of the data line Data. Within the time period $t_2$, the second gate line Gn+1 turns on the switching transistor TFT3; meanwhile, through the charge sharing between capacitors $C_{LC2}$, $C_{ST2}$ and $C_S$ in the sub-pixel 92, the voltage $V_{C2}$ of the liquid crystal capacitor $C_{LC2}$ of the sub-pixel 92 can be different from the voltage $V_{C1}$ of the liquid crystal capacitor $C_{LC1}$ of the sub-pixel 91.

Please refer to FIGS. 1 and 3, FIG. 3 shows a voltage timing diagram of the capacitors in the two sub-pixels shown in FIG. 1 when the voltage of the pixel structure 9 switches from another gray level (e.g. a gray level lower than the initial gray level shown in FIG. 2) to the same middle gray level, wherein variations of the voltage $V_{C1}$ of the liquid crystal capacitor $C_{LC1}$ of the sub-pixel 91 and the voltage $V_{C2}$ of the liquid crystal capacitor $C_{LC2}$ of the sub-pixel 92 are similar to those shown in FIG. 2. The difference is that, the sharing capacitor $C_S$ has a lower voltage $V_{CS}'$ before the second gate line Gn+1 turns on the switching transistor TFT3, so the voltage $V_{C2}'$ of the liquid crystal capacitor $C_{LC2}$ of the sub-pixel 92 shown in FIG. 3 and the voltage $V_{C2}$ of the liquid crystal capacitor $C_{LC2}$ shown in FIG. 2 will have different gray level voltages after the switching transistor TFT3 is turned on. That is, the gray level voltage of the sub-pixel 92 during each display period will be influenced by the gray level voltage of previous frame.

Accordingly, it is necessary to provide a pixel structure of a liquid crystal display that can more correctly control the gray level voltage of sub-pixel.

SUMMARY

The present invention provides a pixel structure and a driving method thereof, wherein the charge sharing capacitor in the sub-pixel of each pixel structure is coupled to a variable voltage, such that sub-pixels can reach desired gray level voltages after charge sharing through controlling the variable voltage.

The present invention further provides a pixel structure and a driving method thereof, wherein a voltage of the charge sharing capacitor in the sub-pixel is previously reset before charge sharing, such that sub-pixels can reach desired gray level voltages after charge sharing.

The present invention provides a pixel structure including a first gate line, a data line for providing gray level voltages, a first sub-pixel and a second sub-pixel. The first sub-pixel includes a first switching transistor and a first liquid crystal capacitor, wherein when the first gate line turns on the first switching transistor, the data line biases the first liquid crystal capacitor to a first gray level voltage through the first switching transistor. The second sub-pixel includes a second switching transistor, a second liquid crystal capacitor, a third switching transistor coupled to a second gate line, and a charge sharing capacitor coupled to a variable voltage, wherein when the first gate line turns on the second switching transistor, the data line biases the second liquid crystal capacitor to the first gray level voltage through the second switching transistor; and when the second gate line turns on the third switching transistor, the second liquid crystal capacitor and the charge sharing capacitor are charge-shared to a second gray level voltage through the third switching transistor; wherein the second gray level voltage is changed according to the variable voltage.

The present invention further provides a pixel structure includes a first gate line, a data line for providing gray level voltages, a first sub-pixel and a second sub-pixel. The first sub-pixel includes a first switching transistor and a first liquid crystal capacitor, wherein when the first gate line turns on the first switching transistor, the data line biases the first liquid crystal capacitor to a first gray level voltage through the first switching transistor. The second sub-pixel includes a second switching transistor, a second liquid crystal capacitor, a third switching transistor coupled to a second gate line, a charge sharing capacitor and a fourth switching transistor, wherein when the first gate line turns on the second switching transistor, the data line biases the second liquid crystal capacitor to the first gray level voltage through the second switching transistor; when the first gate line turns on the fourth switching transistor, the charge sharing capacitor is reset to a predetermined voltage; and when the second gate line turns on the third switching transistor, the second liquid crystal capacitor and the charge sharing capacitor are charge-shared to a second gray level voltage through the third switching transistor.

The present invention further provides a driving method of a pixel structure. The pixel structure includes a first gate line, a first sub-pixel and a second sub-pixel. The first sub-pixel includes a first switching transistor and a first liquid crystal capacitor. The second sub-pixel includes a second switching transistor, a second liquid crystal capacitor, a charge sharing capacitor and a third switching transistor coupled to a second gate line. The driving method includes the steps of: turning on the first switching transistor and the second switching transistor with the first gate line to bias the first liquid crystal capacitor and the second liquid crystal capacitor to a first gray level voltage; resetting the charge sharing capacitor to a predetermined voltage; and turning on the third switching transistor with the second gate line thereby allowing the second liquid crystal capacitor and the charge sharing capacitor to be charge-shared to a second gray level voltage.

The present invention further provides a driving method of a pixel structure. The pixel structure includes a first gate line, a first sub-pixel and a second sub-pixel. The first sub-pixel includes a first switching transistor and a first liquid crystal capacitor. The second sub-pixel includes a second switching transistor, a second liquid crystal capacitor, a third switching transistor coupled to a second gate line, and a charge sharing capacitor coupled to a variable voltage. The driving method includes the steps of: turning on the first switching transistor and the second switching transistor with the first gate line to bias the first liquid crystal capacitor and the second liquid crystal capacitor to a first gray level voltage; changing the variable voltage according to a voltage of the charge sharing capacitor; and turning on the third switching transistor with the second gate line thereby allowing the second liquid crystal capacitor and the charge sharing capacitor to be charge-shared to a second gray level voltage.

In the pixel structure and its driving method of the present invention, the voltage of the charge sharing capacitor may be reset to a fixed voltage or a variable voltage. The fixed voltage may be the common voltage of an array substrate, and the variable voltage may be determined according to the voltage of the charge sharing capacitor in the immediately previous frame period. In this manner, the sub-pixels can reach desired gray level voltages after charge sharing.

BRIEF DESCRIPTION OF THE DRAWINGS

Other objects, advantages, and novel features of the present invention will become more apparent from the following detailed description when taken in conjunction with the accompanying drawings.

DETAILED DESCRIPTION OF THE EMBODIMENT

It should be noticed that, wherever possible, the same reference numbers will be used throughout the drawings to refer to the same or like parts.

Figure 4:
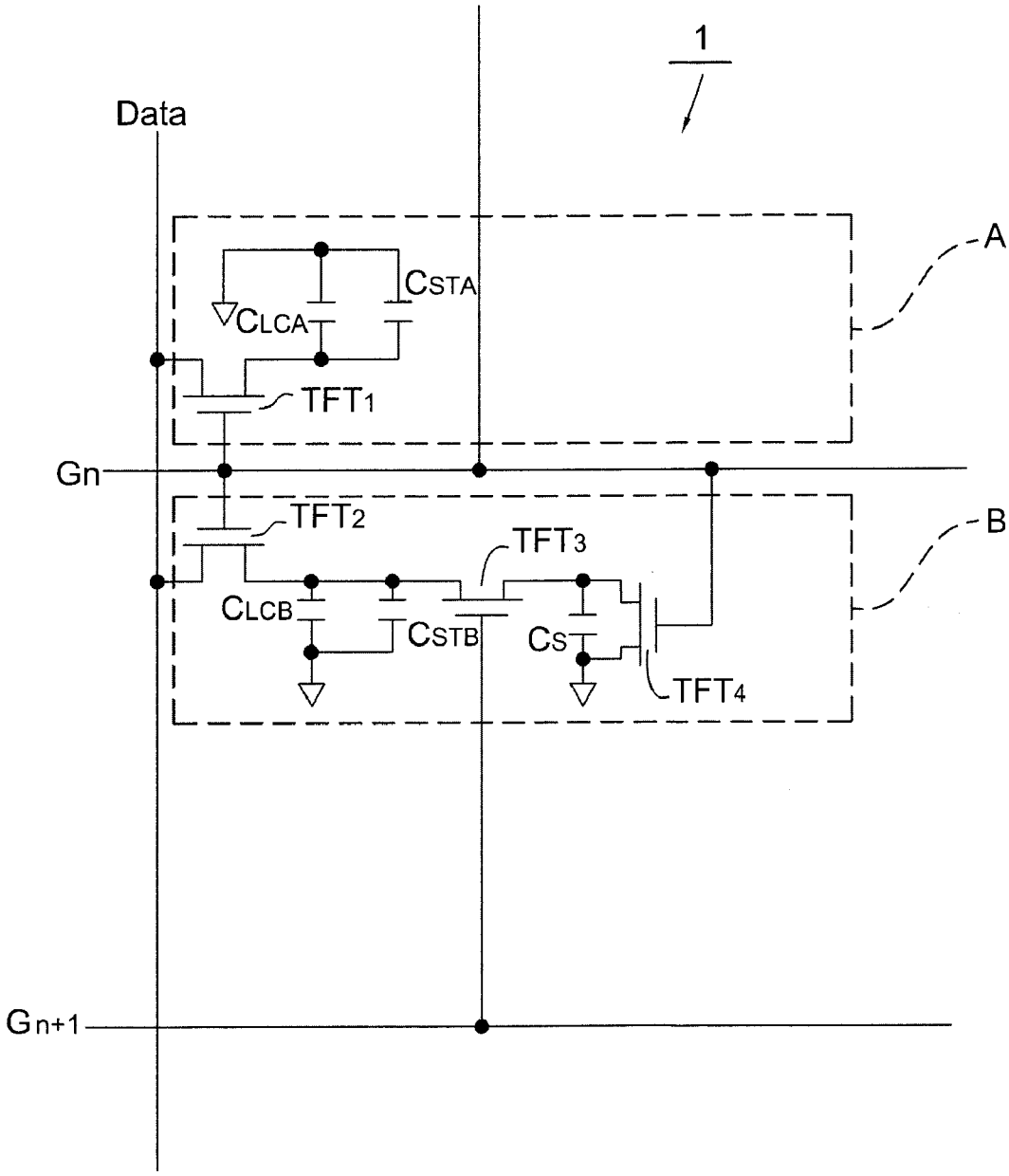
FIG. 4 shows a schematic diagram of the pixel structure according to an embodiment of the present invention.

Please refer to FIG. 4, it shows a pixel structure 1 according to an embodiment of the present invention. The pixel structure 1 includes a first gate line Gn, a data line Data, a first sub-pixel A and a second sub-pixel B, wherein the data line Data is configured to provide gray level voltages to a row of pixel structures during display periods. In this embodiment, the first sub-pixel A and the second sub-pixel B may have different gray level voltages during display periods of the pixel structure 1 by means of charge sharing. It should be understood that, the pixel structure 1 shown in FIG. 4 only shows the components for illustrating the present invention and omits other components.

The first sub-pixel A includes a first switching transistor TFT1, a first liquid crystal capacitor $C_{LCA}$ and a first storage capacitor $C_{STA}$. The gate of the first switching transistor TFT1 is coupled to the first gate line Gn; a first terminal of the first switching transistor TFT1 is coupled to the data line Data; and a second terminal of the first switching transistor TFT1 is coupled to the first terminal of the first liquid crystal capacitor $C_{LCA}$ and the first storage capacitor $C_{STA}$. And the other terminal of the first liquid crystal capacitor $C_{LCA}$ and the first storage capacitor $C_{STA}$ is coupled to a voltage source, e.g. the common voltage (Vcom) of an array substrate. When the first gate line Gn turns on the first switching transistor TFT1, the data line Data biases the first liquid crystal capacitor $C_{LCA}$ and the first storage capacitor $C_{STA}$ through the first switching transistor TFT1, such that the first sub-pixel A shows a first gray level voltage in a display period.

Figure 2:
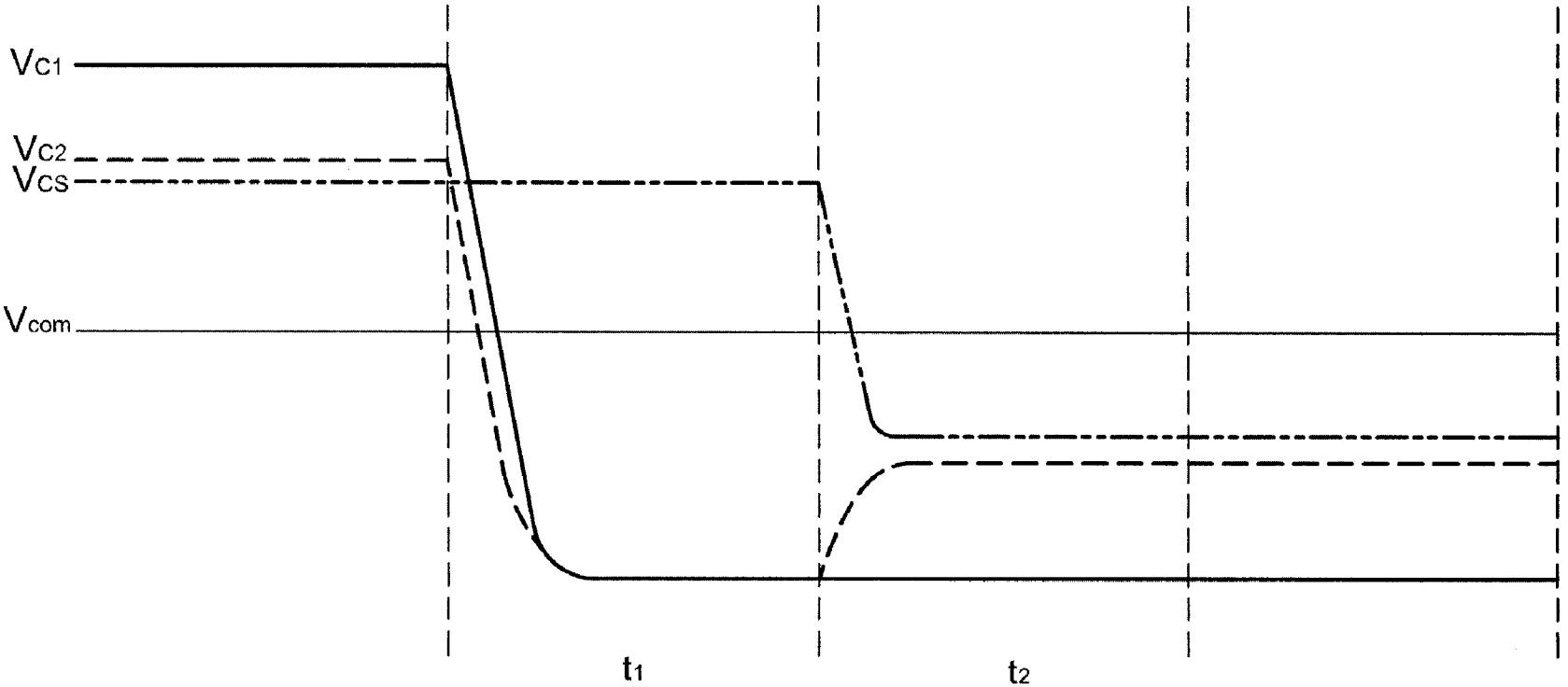
FIG. 2 shows a timing diagram of voltages of the capacitors in the pixel structure shown in FIG. 1.
Figure 3:
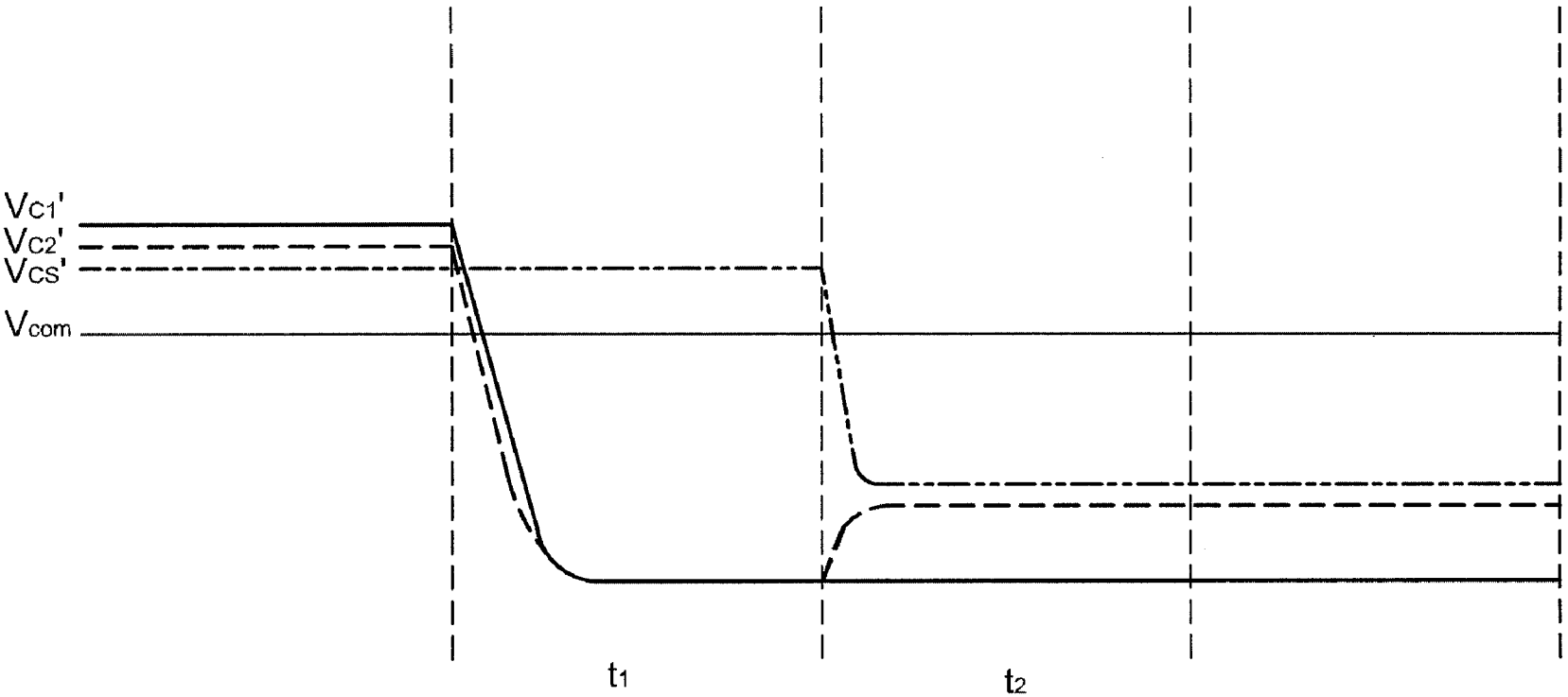
FIG. 3 shows another timing diagram of voltages of the capacitors in the pixel structure shown in FIG. 1.

The second sub-pixel B includes a second switching transistor TFT2, a second liquid crystal capacitor $C_{LCB}$, a second storage capacitor $C_{STB}$, a third switching transistor TFT3 and a charge sharing capacitor $C_S$. The gate of the second switching transistor TFT2 is coupled to the first gate line Gn; a first terminal of the second switching transistor TFT2 is coupled to the data line Data; and a second terminal of the second switching transistor TFT2 is coupled to the first terminal of the second liquid crystal capacitor $C_{LCB}$ and the second storage capacitor $C_{STB}$. And the second terminal of the second liquid crystal capacitor $C_{LCB}$ and the second storage capacitor $C_{STB}$ is coupled to a voltage source, e.g. the common voltage (Vcom) of an array substrate. The gate of the third switching transistor TFT3 is coupled to a second gate line Gn+1, which is adjacent to the first gate line Gn; a first terminal of the third switching transistor TFT3 is coupled to the first terminal of the second liquid crystal capacitor $C_{LCB}$ and the second storage capacitor $C_{STB}$; and a second terminal of the third switching transistor TFT3 is coupled to a first terminal of the charge sharing capacitor $C_S$. And a second terminal of the charge sharing capacitor $C_S$ is coupled to a voltage source, which is a variable voltage source and its voltage may change, for example, according to the voltage of the second sub-pixel B (i.e. the voltage of the charge sharing capacitor $C_S$) in the immediately previous frame of each display period, such that the second sub-pixel B can reach desired gray level voltages after charge charging. In this embodiment, voltage variations of the capacitors in both sub-pixels are similar to those shown in FIGS. 2 and 3. The differences between this embodiment and FIGS. 2 and 3 are that, the voltage of Vcom is a variable voltage in this embodiment and the variable voltage is determined according to the voltage $V_{CS}$ of the second sub-pixel B (i.e. the voltage of the charge sharing capacitor $C_S$) before the switching transistor TFT3 is turned on (i.e. previous frame). That is, the variable voltage is determined according to the voltage of $V_{CS}$ before the second time period $t_2$ in FIGS. 2 and 3.

Please refer to FIG. 4 again, in another embodiment, before the second sub-pixel B is charged shared, it is able to reset the voltage of the charge sharing capacitor $C_S$ to a fixed voltage or a variable voltage. In this embodiment, for example, a fourth switching transistor TFT4 may be further formed in the second sub-pixel B. The gate of the fourth switching transistor TFT4 is coupled to the first gate line Gn; a first terminal of the fourth switching transistor TFT4 is coupled to the first terminal of the charge sharing capacitor $C_S$; and a second terminal of the fourth switching transistor TFT4 is coupled to the second terminal of the charge sharing capacitor $C_S$. In this manner, when the first gate line Gn turns on the first switching transistor TFT1 and the second switching transistor TFT2, the fourth switching transistor TFT4 is also turned on at the same time so as to reset the voltage of the charge sharing capacitor $C_S$ to a fixed voltage or a variable voltage, wherein the fixed voltage may be the common voltage of an array substrate, and the variable voltage may be, for example, determined according to the gray level voltage of the second sub-pixel B in the immediately previous frame of each display period of the pixel structure 1, such that the second pixel B can reach desired gray level voltages after charge sharing.

Figure 5:
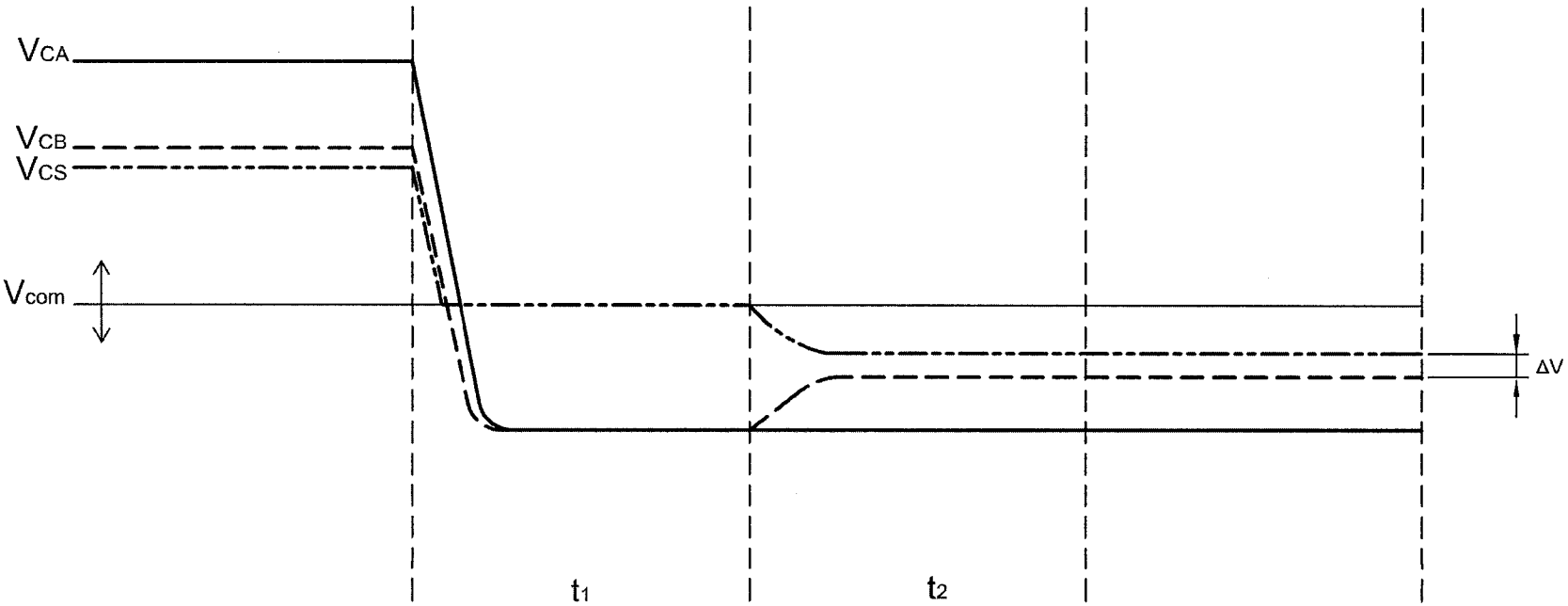
FIG. 5 shows a timing diagram of voltages of the capacitors in the pixel structure shown in FIG. 4.

Please refer to FIGS. 4 and 5, FIG. 5 shows a voltage timing diagram of the capacitors in the two sub-pixels shown in FIG. 4 when the voltage of the pixel structure 1, for example, switching from a high gray level to a middle gray level, wherein $t_1$ is a time period that the first gate line Gn turns on the pixel structure 1 and $t_2$ is a time period that the second gate line Gn+1 turns on a pixel structure (not shown) connected thereto. As shown in FIGS. 4 and 5, within the time period $t_1$, the first gate line Gn simultaneously turns on the first switching transistor TFT1, the second switching transistor TFT2 and the fourth switching transistor TFT4, such that the voltage $V_{CA}$ of the liquid crystal capacitor $C_{LCA}$ of the first sub-pixel A (i.e. the voltage of the first liquid crystal capacitor $C_{LCA}$ and the first storage capacitor $C_{STA}$) and the voltage $V_{CB}$ of the liquid crystal capacitor $C_{LCB}$ of the second sub-pixel B (i.e. the voltage of the second liquid crystal capacitor $C_{LCB}$ and the second storage capacitor $C_{STB}$) decrease to a first gray level voltage together according to the voltage of the data line Data; and the voltage $V_{CS}$ of the charge sharing capacitor $C_S$ is reset to a fixed voltage or a variable voltage, e.g. a common voltage Vcom in this embodiment. Within the time period $t_2$, the second gate line Gn+1 turns on the third switching transistor TFT3. Meanwhile, through charge sharing between the second liquid crystal capacitor $C_{LCB}$, the second storage capacitor $C_{STB}$ and the charge sharing capacitor $C_S$ in the second sub-pixel B, the voltage $V_{CB}$ of the liquid crystal capacitor $C_{LCB}$ of the second sub-pixel B changes to a second gray level voltage, which is different from the first gray level voltage of the first sub-pixel A, wherein a voltage difference $\Delta V$ between the voltage $V_{CB}$ of the liquid crystal capacitor $C_{LCB}$ of the second sub-pixel B and the voltage $V_{CS}$ of the charge sharing capacitor $C_S$ is caused by the third switching transistor TFT3.

Figure 6:
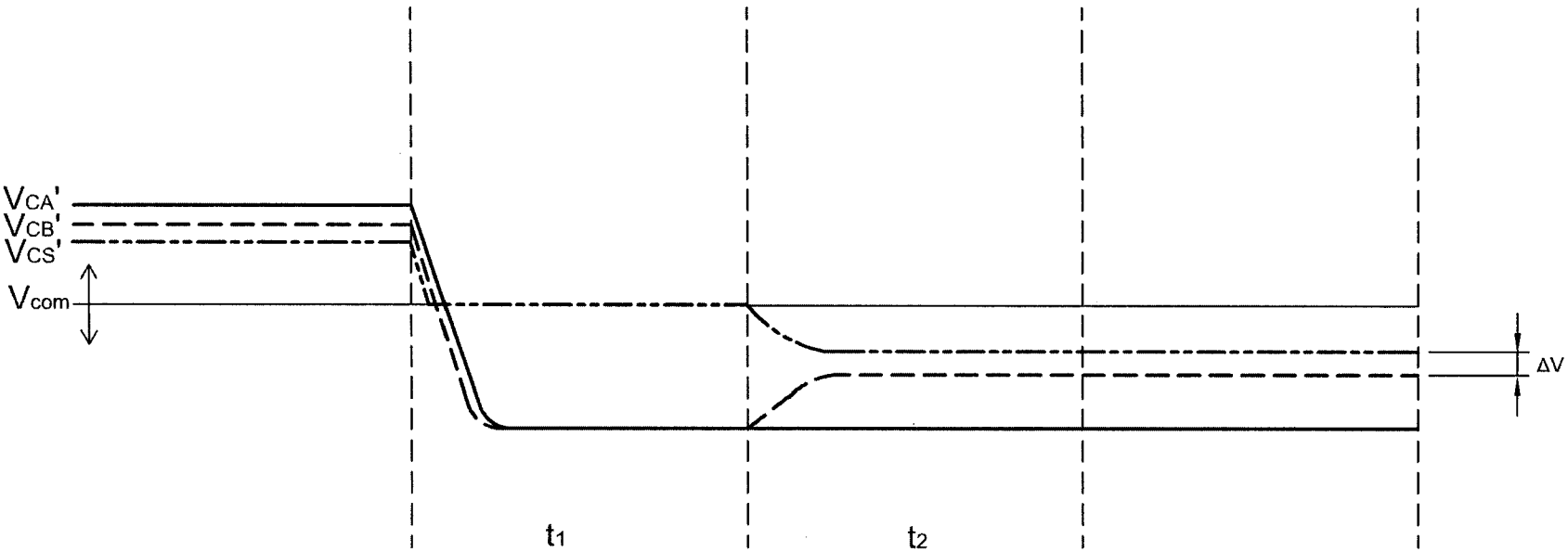
FIG. 6 shows another timing diagram of voltages of the capacitors in the pixel structure shown in FIG. 4.

Please refer to FIGS. 4 to 6, FIG. 6 shows a voltage timing diagram of the capacitors in the two sub-pixels shown in FIG. 4 when the voltage of the pixel structure 1 switching from another gray level (e.g. a gray level lower than the initial gray level shown in FIG. 5) to the middle gray level identical to that shown in FIG. 5, wherein within both time periods $t_1$ and $t_2$, variations of the voltage $V_{CA}$ of the liquid crystal capacitor $C_{LCA}$ of the first sub-pixel A and the voltage $V_{CB}$ of the liquid crystal capacitor $C_{LCB}$ of the second sub-pixel B are similar to those shown in FIG. 5. In FIG. 6, as the charge sharing capacitor $C_S$ has been previously reset to a predetermined voltage in the first time period $t_1$, the voltage of the second sub-pixel B can accurately reach desired gray level voltages after the charge sharing in the second time period $t_2$, i.e. the voltage $V_{CB}$ of the liquid crystal capacitor $C_{LCB}$ in FIG. 5 and the voltage $V_{CB}'$ of the liquid crystal capacitor $C_{LCB}$ in FIG. 6 will have an identical voltage after the second time period $t_2$.

The driving method of the pixel structure of the present invention includes the steps of: turning on the first switching transistor TFT1 and the second switching transistor TFT2 with the first gate line Gn to respectively bias the first liquid crystal capacitor $C_{LCA}$ and the second liquid crystal capacitor $C_{LCB}$ to a first gray level voltage; resetting the charge sharing capacitor $C_S$ to a predetermined voltage; and turning on the third switching transistor TFT3 with the second gate line Gn+1 thereby allowing the second liquid crystal capacitor $C_{LCB}$ and the charge sharing capacitor $C_S$ to be charge-shared to a second gray level voltage. The driving method of pixel structure of the present invention has been illustrated above (FIGS. 4 to 6) and details will not be repeated herein.

The driving method of the pixel structure according to another embodiment of the present invention includes the steps of: turning on the first switching transistor TFT1 and the second switching transistor TFT2 with the first gate line Gn to respectively bias the first liquid crystal capacitor $C_{LCA}$ and the second liquid crystal capacitor $C_{LCB}$ to a first gray level voltage; changing the variable voltage according to the voltage of the charge sharing capacitor $C_S$; and turning on the third switching transistor TFT3 with the second gate line Gn+1 thereby allowing the second liquid crystal capacitor $C_{LCB}$ and the charge sharing capacitor $C_S$ to be charge-shared to a second gray level voltage.

Figure 1:
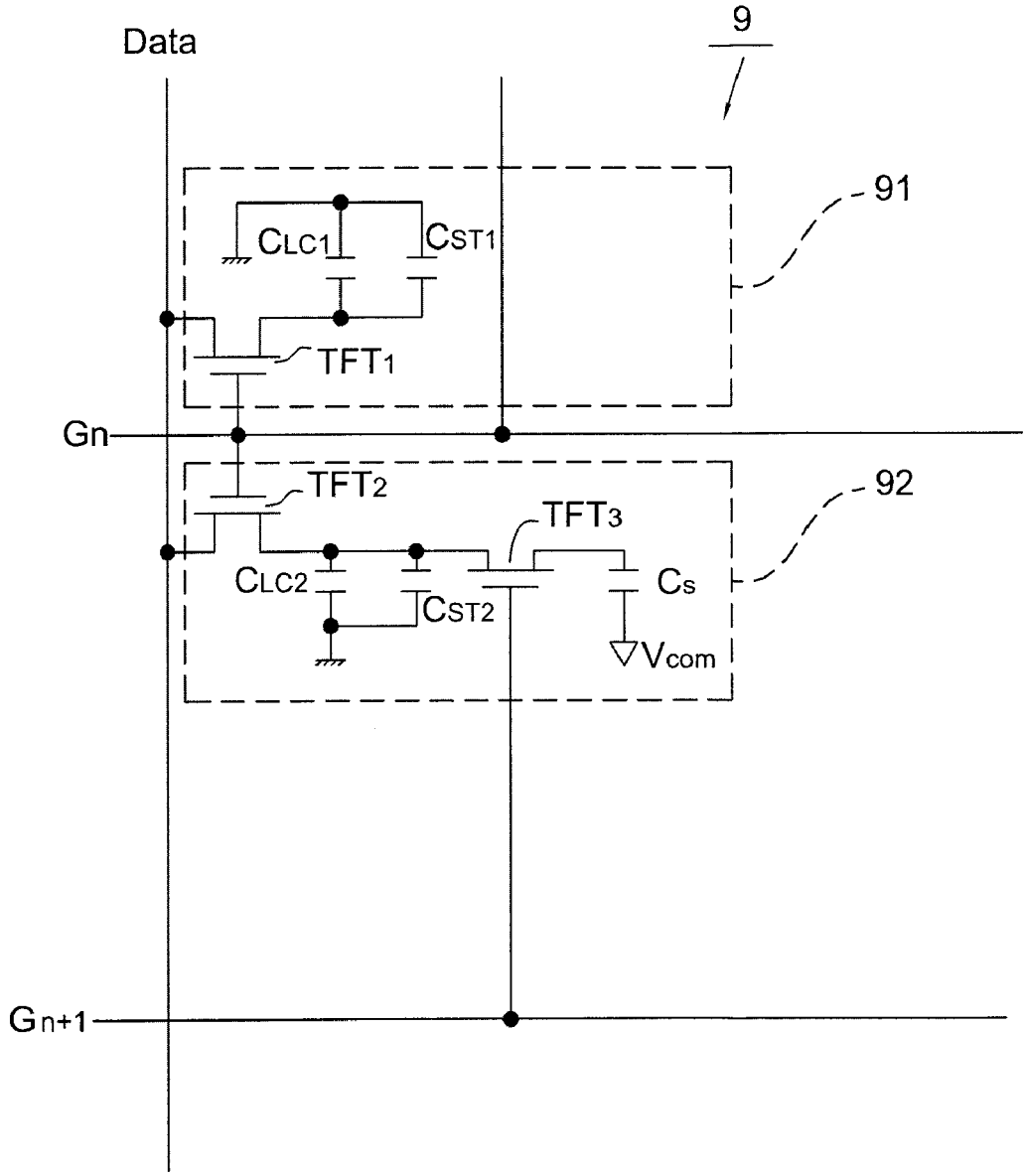
FIG. 1 shows a schematic diagram of a conventional pixel structure.

As mentioned above, because sub-pixels of the conventional pixel structure (as shown in FIG. 1) have the problem of unable to accurately reach the desired gray level voltages during display periods, the present invention further provides a pixel structure (as shown in FIG. 4) that previously resets the gray level voltage of the charge sharing capacitor before charge sharing so as to more accurately control the gray level voltage.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. A pixel structure, comprising:

a first gate line;

a data line, for providing gray level voltages;

a first sub-pixel, comprising a first switching transistor and a first liquid crystal capacitor, wherein when the first gate line turns on the first switching transistor, the data line biases the first liquid crystal capacitor to a first gray level voltage through the first switching transistor; and a second sub-pixel, comprising a second switching transistor, a second liquid crystal capacitor, a third switching transistor coupled to a second gate line, and a charge sharing capacitor coupled to a variable voltage, wherein when the first gate line turns on the second switching transistor, the data line biases the second liquid crystal capacitor to the first gray level voltage through the second switching transistor; and when the second gate line turns on the third switching transistor, the second liquid crystal capacitor and the charge sharing capacitor are charge-shared to a second gray level voltage through the third switching transistor;

wherein the second gray level voltage is changed according to the variable voltage.

2. The pixel structure as claimed in claim 1, wherein the variable voltage is determined according to a voltage of the charge sharing capacitor before the third switching transistor is turned on.

3. The pixel structure as claimed in claim 1, wherein the second sub-pixel further comprises a second storage capacitor for charge sharing with the second liquid crystal capacitor and the charge sharing capacitor.

4. The pixel structure as claimed in claim 1, wherein the first gate line simultaneously turns on the first switching transistor and the second switching transistor.

5. A pixel structure, comprising:

a first gate line;

a data line, for providing gray level voltages;

a first sub-pixel, comprising a first switching transistor and a first liquid crystal capacitor, wherein when the first gate line turns on the first switching transistor, the data line biases the first liquid crystal capacitor to a first gray level voltage through the first switching transistor; and a second sub-pixel, comprising a second switching transistor, a second liquid crystal capacitor, a third switching transistor coupled to a second gate line, a charge sharing capacitor and a fourth switching transistor, wherein when the first gate line turns on the second switching transistor, the data line biases the second liquid crystal capacitor to the first gray level voltage through the second switching transistor; when the first gate line turns on the fourth switching transistor, the charge sharing capacitor is reset to a predetermined voltage; and when the second gate line turns on the third switching transistor, the second liquid crystal capacitor and the charge sharing capacitor are charge-shared to a second gray level voltage through the third switching transistor.

6. The pixel structure as claimed in claim 5, wherein the predetermined voltage is a fixed voltage or a variable voltage.

7. The pixel structure as claimed in claim 6, wherein the fixed voltage is a common voltage.

8. The pixel structure as claimed in claim 6, wherein the variable voltage is determined according to a voltage of the charge sharing capacitor before being reset.

9. The pixel structure as claimed in claim 5, wherein the first gate line simultaneously turns on the first, the second and the fourth switching transistors.

10. The pixel structure as claimed in claim 5, wherein the second sub-pixel further comprises a second storage capacitor for charge sharing with the second liquid crystal capacitor and the charge sharing capacitor.

11. A driving method of a pixel structure, the pixel structure comprising a first gate line, a first sub-pixel and a second sub-pixel, the first sub-pixel comprising a first switching transistor and a first liquid crystal capacitor, the second sub-pixel comprising a second switching transistor, a second liquid crystal capacitor, a charge sharing capacitor and a third switching transistor coupled to a second gate line, the driving method comprising the steps of:

turning on the first switching transistor and the second switching transistor with the first gate line to bias the first liquid crystal capacitor and the second liquid crystal capacitor to a first gray level voltage;

resetting the charge sharing capacitor to a predetermined voltage; and turning on the third switching transistor with the second gate line thereby allowing the second liquid crystal capacitor and the charge sharing capacitor to be charge-shared to a second gray level voltage.

12. The driving method as claimed in claim 11, wherein the predetermined voltage is a fixed voltage or a variable voltage.

13. The driving method as claimed in claim 12, wherein the fixed voltage is a common voltage.

14. The driving method as claimed in claim 12, wherein the variable voltage is determined according to a voltage of the charge sharing capacitor before being reset.

15. The driving method as claimed in claim 11, wherein the first gate line simultaneously turns on the first and the second switching transistors.

16. The driving method as claimed in claim 11, wherein the second sub-pixel further comprises a fourth switching transistor and the step of resetting the charge sharing capacitor to a predetermined voltage further comprises: turning on the fourth switching transistor with the first gate line to reset the charge sharing capacitor.

17. The driving method as claimed in claim 16, wherein the first gate line simultaneously turns on the first, the second and the fourth switching transistors.

18. The driving method as claimed in claim 11, wherein the second gate line is adjacent to the first gate line.

19. A driving method of a pixel structure, the pixel structure comprising a first gate line, a first sub-pixel and a second sub-pixel, the first sub-pixel comprising a first switching transistor and a first liquid crystal capacitor, the second sub-pixel comprising a second switching transistor, a second liquid crystal capacitor, a third switching transistor coupled to a second gate line, and a charge sharing capacitor coupled to a variable voltage, the driving method comprising the steps of:

turning on the first switching transistor and the second switching transistor with the first gate line to bias the first liquid crystal capacitor and the second liquid crystal capacitor to a first gray level voltage;

changing the variable voltage according to a voltage of the charge sharing capacitor; and turning on the third switching transistor with the second gate line thereby allowing the second liquid crystal capacitor and the charge sharing capacitor to be charge-shared to a second gray level voltage.

20. The driving method as claimed in claim 19, wherein the second gate line is adjacent to the first gate line.

* * * * *